US011302227B2

(12) United States Patent
Kim et al.

(10) Patent No.: US 11,302,227 B2
(45) Date of Patent: Apr. 12, 2022

(54) METHOD FOR COMPENSATING FOR DEGRADATION ON BASIS OF EXECUTION SCREEN OF APPLICATION AND ELECTRONIC DEVICE IMPLEMENTING SAME

(71) Applicant: Samsung Electronics Co., Ltd., Suwon-si (KR)

(72) Inventors: Hanyuool Kim, Suwon-si (KR); Taewoong Lee, Suwon-si (KR); Seungkyu Choi, Suwon-si (KR); Dongkyoon Han, Suwon-si (KR); Kwangtai Kim, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 17/292,852

(22) PCT Filed: Nov. 12, 2019

(86) PCT No.: PCT/KR2019/015315
§ 371 (c)(1),
(2) Date: May 11, 2021

(87) PCT Pub. No.: WO2020/111576
PCT Pub. Date: Jun. 4, 2020

(65) Prior Publication Data

US 2021/0398463 A1 Dec. 23, 2021

(30) Foreign Application Priority Data

Nov. 28, 2018 (KR) ..... 10-2018-0149267

(51) Int. Cl.
*G09G 3/00* (2006.01)
*G09G 5/36* (2006.01)

(52) U.S. Cl.
CPC ..... *G09G 3/006* (2013.01); *G09G 5/363* (2013.01); *G09G 2320/0257* (2013.01); *G09G 2320/043* (2013.01); *G09G 2320/0686* (2013.01)

(58) Field of Classification Search
CPC ..... G09G 3/006; G09G 5/36–363; G09G 2320/0233; G09G 2320/0257–0261;
(Continued)

(56) References Cited

U.S. PATENT DOCUMENTS 8,818,073 B2 8/2014 Lee et al.
9,715,843 B2 7/2017 Li
(Continued)

FOREIGN PATENT DOCUMENTS

KR 10-0746780 B1 8/2007
KR 10-2012-0011546 A 2/2012
(Continued)

*Primary Examiner* — Amare Mengistu
*Assistant Examiner* — Gloryvid Figueroa-Gibson
(74) *Attorney, Agent, or Firm* — Jefferson IP Law, LLP

(57) ABSTRACT

Disclosed is an electronic device including a display, a display driving circuit which drives the display, and at least one processor operationally connected to the display or the display driving circuit, wherein the at least one processor gives an afterimage risk ranking to each of a plurality of applications, and, when an application given an afterimage risk ranking higher than a designated range among the plurality of applications is executed, generates afterimage data by accumulating images sampled from the execution screens of the application given the afterimage risk ranking higher than the designated range, and delivers the afterimage data to the display driving circuit. Various other embodiments that can be understood through the present specification are also possible.

15 Claims, 11 Drawing Sheets

(58) Field of Classification Search
CPC ..... G09G 2320/043; G09G 2320/048; G09G 2320/06–0626; G09G 2320/0686
USPC ..... 345/87
See application file for complete search history.

(56) References Cited

U.S. PATENT DOCUMENTS

| | | | | |
|---|---|---|---|---|
| 10,062,363 | B2 | 8/2018 | Kang et al. | |
| 2008/0204596 | A1* | 8/2008 | Koh | H04N 21/4345 348/563 |
| 2012/0026315 | A1 | 2/2012 | Lee et al. | |
| 2013/0311946 | A1 | 11/2013 | Kwon | |
| 2015/0371576 | A1 | 12/2015 | Li | |
| 2016/0217770 | A1 | 7/2016 | Kang et al. | |

FOREIGN PATENT DOCUMENTS

| | | | |
|---|---|---|---|
| KR | 10-1233955 | B1 | 2/2013 |
| KR | 10-2017-0079882 | A | 7/2017 |
| KR | 10-2017-0081032 | A | 7/2017 |
| WO | 2015/060501 | A1 | 4/2015 |

* cited by examiner

METHOD FOR COMPENSATING FOR DEGRADATION ON BASIS OF EXECUTION SCREEN OF APPLICATION AND ELECTRONIC DEVICE IMPLEMENTING SAME

TECHNICAL FIELD

Embodiments disclosed in the disclosure relate to a technology for compensating for degradation of a display by collecting and analyzing information about the degradation according to a shape of an execution screen of an application displayed on a screen of the display.

BACKGROUND ART

An electronic device includes a display that displays an execution screen of an application. The execution screen has a region where a uniform luminance or a uniform display shape is maintained while the application is executed, and a region changed depending on an operation of the application or a user input. Regions where a uniform luminance or a uniform display shape is maintained in each of a plurality of applications are different from one another.

In the meantime, when a display panel such as an organic light emitting diode (OLED) displays a uniform screen for a long time, the display that displays a screen may be degraded and an afterimage may occur. When degradation or burn-in occurs in a light emitting element constituting a pixel of the display, the luminance of the pixel may be reduced, and thus image representation may be uneven.

DISCLOSURE

Technical Problem

An electronic device to which a conventional afterimage compensation technology is applied may sample and accumulate image data or current data according to a screen for each frame at a specified time interval. When performing the sampling independently of the type of an application being executed, a display driver integrated circuit (DDI) needs to access a processor or a memory for the purpose of processing or storing sampling data obtained at a specified time interval regardless of the shape of an execution screen.

As the sampling is performed regardless of the shape of the execution screen, power may be consumed unnecessarily to perform the sampling on up to a region where a uniform luminance or uniform display shape is maintained. Furthermore, when the sampling is performed regardless of the shape of the execution screen, the amount of accumulated data may increase in proportion to a display resolution or usage time. In particular, as the power of a battery is consumed excessively when an afterimage compensation technology is applied, there are few electronic devices to which the afterimage compensation technology is applied.

Embodiments disclosed in this specification are intended to provide the electronic device for solving the above-described problem and problems brought up in this specification.

Technical Solution

According to an embodiment disclosed in this specification, an electronic device may include a display, a display driver integrated circuit (DDI) driving the display, and at least one processor operationally connected to the display or the DDI. The at least one processor may assign an afterimage risk priority to each of the plurality of applications, may generate afterimage data by accumulating an image obtained by sampling an execution screen of the application, of which the afterimage risk priority is assigned to be over the specified range, when an application, of which the afterimage risk priority is assigned to be over a specified range, from among the plurality of applications is executed, and may deliver the afterimage data to the DDI.

Furthermore, according to an embodiment disclosed in this specification, a degradation compensating method of an electronic device may include assigning an afterimage risk priority to each of the plurality of applications, generating afterimage data by accumulating an image obtained by sampling an execution screen of the application, of which the afterimage risk priority is assigned to be over the specified range, when an application, of which the afterimage risk priority is assigned to be over a specified range, from among the plurality of applications is executed, and delivering the afterimage data to a DDI.

Moreover, according to an embodiment disclosed in this specification, an electronic device may include a display, a DDI driving the display, and at least one processor operationally connected to the display or the DDI. The at least one processor may be configured to identify information associated with a running application, to determine generation or acquisition of a degradation prevention image for preventing degradation of the display based at least on information associated with the running application, and to deliver the degradation prevention image to the DDI.

Advantageous Effects

According to embodiments disclosed in this specification, a risk priority for occurrence of an afterimage may be assigned depending on the type of an application, and then afterimage prevention or afterimage compensation may be performed by selecting an application, of which an afterimage risk priority is over a specified range.

Moreover, according to embodiments disclosed in this specification, the disclosure may reduce the number of times that sampling is performed, thereby reducing power consumption for afterimage prevention or afterimage compensation.

Also, according to embodiments disclosed in this specification, afterimage prevention or afterimage compensation corresponding to an execution screen of an application may be performed.

Besides, a variety of effects directly or indirectly understood through the specification may be provided.

With regard to description of drawings, the same or similar components will be marked by the same or similar reference signs.

MODE FOR INVENTION

Hereinafter, various embodiments of the disclosure will be described with reference to accompanying drawings. However, it should be understood that this is not intended to limit the disclosure to specific implementation forms and includes various modifications, equivalents, and/or alternatives of embodiments of the disclosure.

Figure 1:
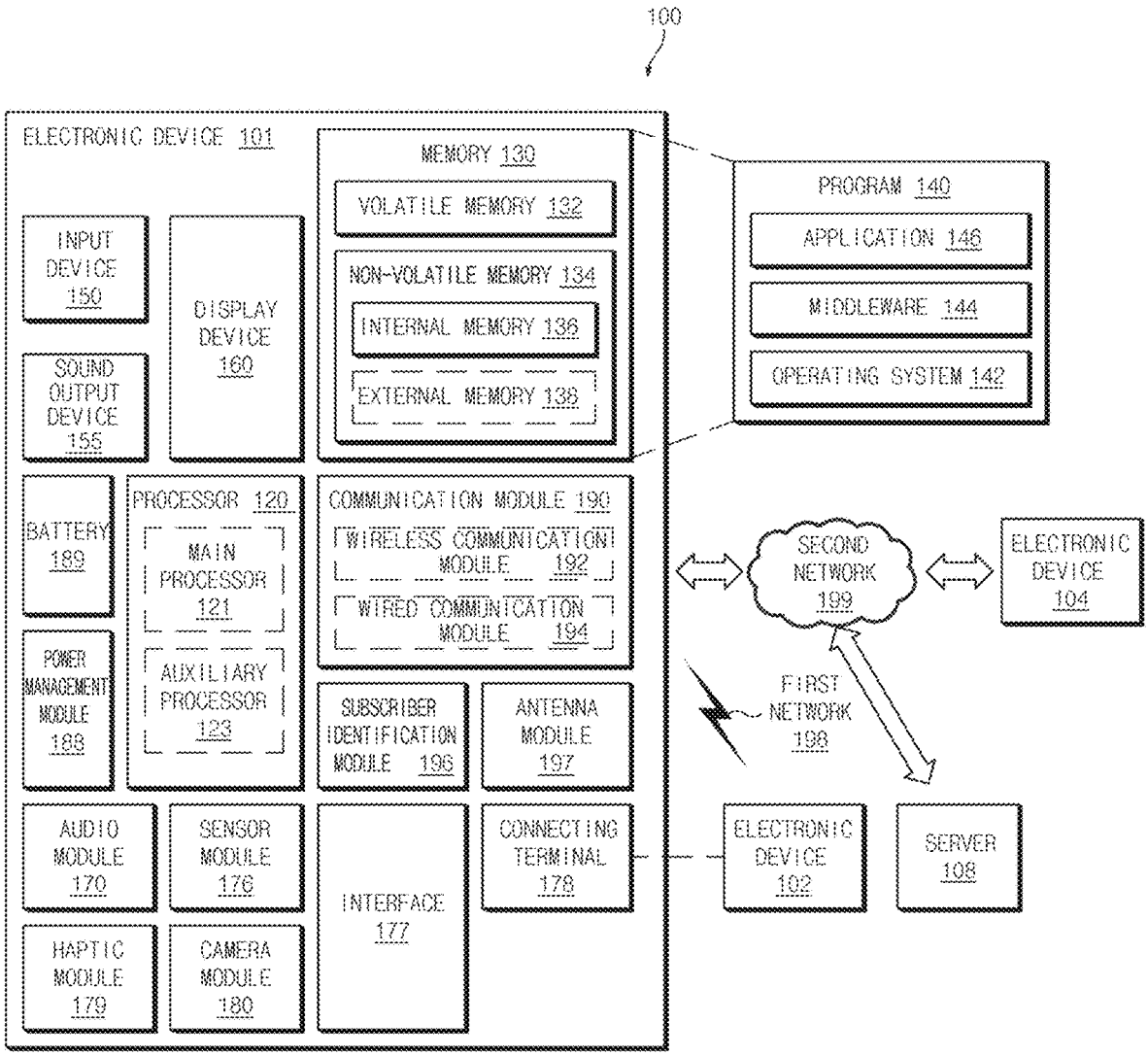
FIG. 1 is a block diagram illustrating an electronic device, compensating for degradation of a display according to a shape of an execution screen of an application, in a network environment according to various embodiments.

FIG. 1 is a block diagram illustrating an electronic device 101, compensating for degradation of a display according to a shape of an execution screen of an application, in a network environment 100 according to various embodiments. Referring to FIG. 1, the electronic device 101 in the network environment 100 may communicate with an electronic device 102 via a first network 198 (e.g., a short-range wireless communication network), or an electronic device 104 or a server 108 via a second network 199 (e.g., a long-range wireless communication network). According to an embodiment, the electronic device 101 may communicate with the electronic device 104 via the server 108. According to an embodiment, the electronic device 101 may include a processor 120, memory 130, an input device 150, a sound output device 155, a display device 160, an audio module 170, a sensor module 176, an interface 177, a haptic module 179, a camera module 180, a power management module 188, a battery 189, a communication module 190, a subscriber identification module (SIM) 196, or an antenna module 197. In some embodiments, at least one (e.g., the display device 160 or the camera module 180) of the components may be omitted from the electronic device 101, or one or more other components may be added in the electronic device 101. In some embodiments, some of the components may be implemented as single integrated circuitry. For example, the sensor module 176 (e.g., a fingerprint sensor, an iris sensor, or an illuminance sensor) may be implemented as embedded in the display device 160 (e.g., a display).

The processor 120 may execute, for example, software (e.g., a program 140) to control at least one other component (e.g., a hardware or software component) of the electronic device 101 coupled with the processor 120, and may perform various data processing or computation. According to one embodiment, as at least part of the data processing or computation, the processor 120 may load a command or data received from another component (e.g., the sensor module 176 or the communication module 190) in volatile memory 132, process the command or the data stored in the volatile memory 132, and store resulting data in non-volatile memory 134. According to an embodiment, the processor 120 may include a main processor 121 (e.g., a central processing unit (CPU) or an application processor (AP)), and an auxiliary processor 123 (e.g., a graphics processing unit (GPU), an image signal processor (ISP), a sensor hub processor, or a communication processor (CP)) that is operable independently from, or in conjunction with, the main processor 121. Additionally or alternatively, the auxiliary processor 123 may be adapted to consume less power than the main processor 121, or to be specific to a specified function. The auxiliary processor 123 may be implemented as separate from, or as part of the main processor 121.

The auxiliary processor 123 may control at least some of functions or states related to at least one component (e.g., the display device 160, the sensor module 176, or the communication module 190) among the components of the electronic device 101, instead of the main processor 121 while the main processor 121 is in an inactive (e.g., sleep) state, or together with the main processor 121 while the main processor 121 is in an active state (e.g., executing an application). According to an embodiment, the auxiliary processor 123 (e.g., an image signal processor or a communication processor) may be implemented as part of another component (e.g., the camera module 180 or the communication module 190) functionally related to the auxiliary processor 123.

The memory 130 may store various data used by at least one component (e.g., the processor 120 or the sensor module 176) of the electronic device 101. The various data may include, for example, software (e.g., the program 140) and input data or output data for a command related thereto. The memory 130 may include the volatile memory 132 or the non-volatile memory 134.

The program 140 may be stored in the memory 130 as software, and may include, for example, an operating system (OS) 142, middleware 144, or an application 146.

The input device 150 may receive a command or data to be used by another component (e.g., the processor 120) of the electronic device 101, from the outside (e.g., a user) of the electronic device 101. The input device 150 may include, for example, a microphone, a mouse, a keyboard, or a digital pen (e.g., a stylus pen).

The sound output device 155 may output sound signals to the outside of the electronic device 101. The sound output device 155 may include, for example, a speaker or a receiver. The speaker may be used for general purposes, such as playing multimedia or playing record, and the receiver may be used for an incoming call. According to an embodiment, the receiver may be implemented as separate from, or as part of the speaker.

The display device 160 may visually provide information to the outside (e.g., a user) of the electronic device 101. The display device 160 may include, for example, a display, a hologram device, or a projector and control circuitry to control a corresponding one of the display, hologram device, and projector. According to an embodiment, the display device 160 may include touch circuitry adapted to detect a touch, or sensor circuitry (e.g., a pressure sensor) adapted to measure the intensity of force incurred by the touch.

The audio module 170 may convert a sound into an electrical signal and vice versa. According to an embodiment, the audio module 170 may obtain the sound via the input device 150, or output the sound via the sound output device 155 or a headphone of an external electronic device (e.g., an electronic device 102) directly (e.g., wiredly) or wirelessly coupled with the electronic device 101.

The sensor module 176 may detect an operational state (e.g., power or temperature) of the electronic device 101 or an environmental state (e.g., a state of a user) external to the electronic device 101, and then generate an electrical signal or data value corresponding to the detected state. According to an embodiment, the sensor module 176 may include, for example, a gesture sensor, a gyro sensor, an atmospheric pressure sensor, a magnetic sensor, an acceleration sensor, a grip sensor, a proximity sensor, a color sensor, an infrared (IR) sensor, a biometric sensor, a temperature sensor, a humidity sensor, or an illuminance sensor.

The interface 177 may support one or more specified protocols to be used for the electronic device 101 to be coupled with the external electronic device (e.g., the electronic device 102) directly (e.g., wiredly) or wirelessly. According to an embodiment, the interface 177 may include, for example, a high definition multimedia interface (HDMI), a universal serial bus (USB) interface, a secure digital (SD) card interface, or an audio interface.

A connecting terminal 178 may include a connector via which the electronic device 101 may be physically connected with the external electronic device (e.g., the electronic device 102). According to an embodiment, the connecting terminal 178 may include, for example, a HDMI connector, a USB connector, a SD card connector, or an audio connector (e.g., a headphone connector).

The haptic module 179 may convert an electrical signal into a mechanical stimulus (e.g., a vibration or a movement) or electrical stimulus which may be recognized by a user via his tactile sensation or kinesthetic sensation. According to an embodiment, the haptic module 179 may include, for example, a motor, a piezoelectric element, or an electric stimulator.

The camera module 180 may capture a still image or moving images. According to an embodiment, the camera module 180 may include one or more lenses, image sensors, image signal processors, or flashes.

The power management module 188 may manage power supplied to the electronic device 101. According to one embodiment, the power management module 188 may be implemented as at least part of, for example, a power management integrated circuit (PMIC).

The battery 189 may supply power to at least one component of the electronic device 101. According to an embodiment, the battery 189 may include, for example, a primary cell which is not rechargeable, a secondary cell which is rechargeable, or a fuel cell.

The communication module 190 may support establishing a direct (e.g., wired) communication channel or a wireless communication channel between the electronic device 101 and the external electronic device (e.g., the electronic device 102, the electronic device 104, or the server 108) and performing communication via the established communication channel. The communication module 190 may include one or more communication processors that are operable independently from the processor 120 (e.g., the application processor (AP)) and supports a direct (e.g., wired) communication or a wireless communication. According to an embodiment, the communication module 190 may include a wireless communication module 192 (e.g., a cellular communication module, a short-range wireless communication module, or a global navigation satellite system (GNSS) communication module) or a wired communication module 194 (e.g., a local area network (LAN) communication module or a power line communication (PLC) module). A corresponding one of these communication modules may communicate with the external electronic device via the first network 198 (e.g., a short-range communication network, such as Bluetooth™ wireless-fidelity (Wi-Fi) direct, or infrared data association (IrDA)) or the second network 199 (e.g., a long-range communication network, such as a cellular network, the Internet, or a computer network (e.g., LAN or wide area network (WAN)). These various types of communication modules may be implemented as a single component (e.g., a single chip), or may be implemented as multi components (e.g., multi chips) separate from each other. The wireless communication module 192 may identify and authenticate the electronic device 101 in a communication network, such as the first network 198 or the second network 199, using subscriber information (e.g., international mobile subscriber identity (IMSI)) stored in the subscriber identification module 196.

The antenna module 197 may transmit or receive a signal or power to or from the outside (e.g., the external electronic device) of the electronic device 101. According to an embodiment, the antenna module 197 may include an antenna including a radiating element composed of a conductive material or a conductive pattern formed in or on a substrate (e.g., PCB). According to an embodiment, the antenna module 197 may include a plurality of antennas. In such a case, at least one antenna appropriate for a communication scheme used in the communication network, such as the first network 198 or the second network 199, may be selected, for example, by the communication module 190 (e.g., the wireless communication module 192) from the plurality of antennas. The signal or the power may then be transmitted or received between the communication module 190 and the external electronic device via the selected at least one antenna. According to an embodiment, another component (e.g., a radio frequency integrated circuit (RFIC)) other than the radiating element may be additionally formed as part of the antenna module 197.

At least some of the above-described components may be coupled mutually and communicate signals (e.g., commands or data) therebetween via an inter-peripheral communication scheme (e.g., a bus, general purpose input and output (GPIO), serial peripheral interface (SPI), or mobile industry processor interface (MIPI)).

According to an embodiment, commands or data may be transmitted or received between the electronic device 101 and the external electronic device 104 via the server 108 coupled with the second network 199. Each of the electronic devices 102 and 104 may be a device of a same type as, or a different type, from the electronic device 101. According to an embodiment, all or some of operations to be executed at the electronic device 101 may be executed at one or more of the external electronic devices 102, 104, or 108. For example, if the electronic device 101 should perform a function or a service automatically, or in response to a request from a user or another device, the electronic device 101, instead of, or in addition to, executing the function or the service, may request the one or more external electronic devices to perform at least part of the function or the service. The one or more external electronic devices receiving the request may perform the at least part of the function or the service requested, or an additional function or an additional service related to the request, and transfer an outcome of the performing to the electronic device 101. The electronic device 101 may provide the outcome, with or without further processing of the outcome, as at least part of a reply to the request. To that end, a cloud computing, distributed computing, or client-server computing technology may be used, for example.

Figure 2:
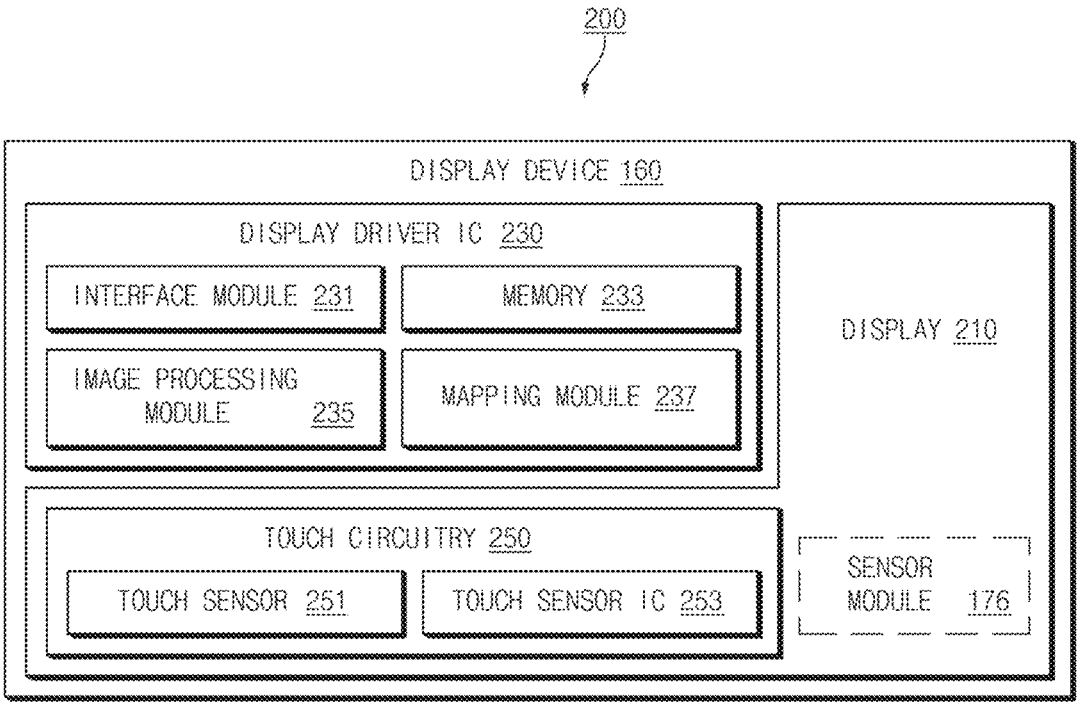
FIG. 2 is a block diagram illustrating the display device, compensating for degradation of a display according to a shape of an execution screen of an application, according to various embodiments.

FIG. 2 is a block diagram 200 illustrating the display device 160, compensating for degradation of a display according to a shape of an execution screen of an application, according to various embodiments. Referring to FIG. 2, the display device 160 may include a display 210 and a display driver integrated circuit (DDI) 230 to control the display 210. The DDI 230 may include an interface module 231, memory 233 (e.g., buffer memory), an image processing module 235, or a mapping module 237. The DDI 230 may receive image information that contains image data or an image control signal corresponding to a command to control the image data from another component of the electronic device 101 via the interface module 231. For example, according to an embodiment, the image information may be received from the processor 120 (e.g., the main processor 121 (e.g., an application processor)) or the auxiliary processor 123 (e.g., a graphics processing unit) operated independently from the function of the main processor 121. The DDI 230 may communicate, for example, with touch circuitry 150 or the sensor module 176 via the interface module 231. The DDI 230 may also store at least part of the received image information in the memory 233, for example, on a frame by frame basis. The image processing module 235 may perform pre-processing or post-processing (e.g., adjustment of resolution, brightness, or size) with respect to at least part of the image data. According to an embodiment, the pre-processing or post-processing may be performed, for example, based at least in part on one or more characteristics of the image data or one or more characteristics of the display 210. The mapping module 237 may generate a voltage value or a current value corresponding to the image data pre-processed or post-processed by the image processing module 235. According to an embodiment, the generating of the voltage value or current value may be performed, for example, based at least in part on one or more attributes of the pixels (e.g., an array, such as an RGB stripe or a pentile structure, of the pixels, or the size of each subpixel). At least some pixels of the display 210 may be driven, for example, based at least in part on the voltage value or the current value such that visual information (e.g., a text, an image, or an icon) corresponding to the image data may be displayed via the display 210.

According to an embodiment, the display device 160 may further include the touch circuitry 250. The touch circuitry 250 may include a touch sensor 251 and a touch sensor IC 253 to control the touch sensor 251. The touch sensor IC 253 may control the touch sensor 251 to sense a touch input or a hovering input with respect to a certain position on the display 210. To achieve this, for example, the touch sensor 251 may detect (e.g., measure) a change in a signal (e.g., a voltage, a quantity of light, a resistance, or a quantity of one or more electric charges) corresponding to the certain position on the display 210. The touch circuitry 250 may provide input information (e.g., a position, an area, a pressure, or a time) indicative of the touch input or the hovering input detected via the touch sensor 251 to the processor 120. According to an embodiment, at least part (e.g., the touch sensor IC 253) of the touch circuitry 250 may be formed as part of the display 210 or the DDI 230, or as part of another component (e.g., the auxiliary processor 123) disposed outside the display device 160.

According to an embodiment, the display device 160 may further include at least one sensor (e.g., a fingerprint sensor, an iris sensor, a pressure sensor, or an illuminance sensor) of the sensor module 176 or a control circuit for the at least one sensor. In such a case, the at least one sensor or the control circuit for the at least one sensor may be embedded in one portion of a component (e.g., the display 210, the DDI 230, or the touch circuitry 150)) of the display device 160. For example, when the sensor module 176 embedded in the display device 160 includes a biometric sensor (e.g., a fingerprint sensor), the biometric sensor may obtain biometric information (e.g., a fingerprint image) corresponding to a touch input received via a portion of the display 210. As another example, when the sensor module 176 embedded in the display device 160 includes a pressure sensor, the pressure sensor may obtain pressure information corresponding to a touch input received via a partial or whole area of the display 210. According to an embodiment, the touch sensor 251 or the sensor module 176 may be disposed between pixels in a pixel layer of the display 210, or over or under the pixel layer.

Figure 3:
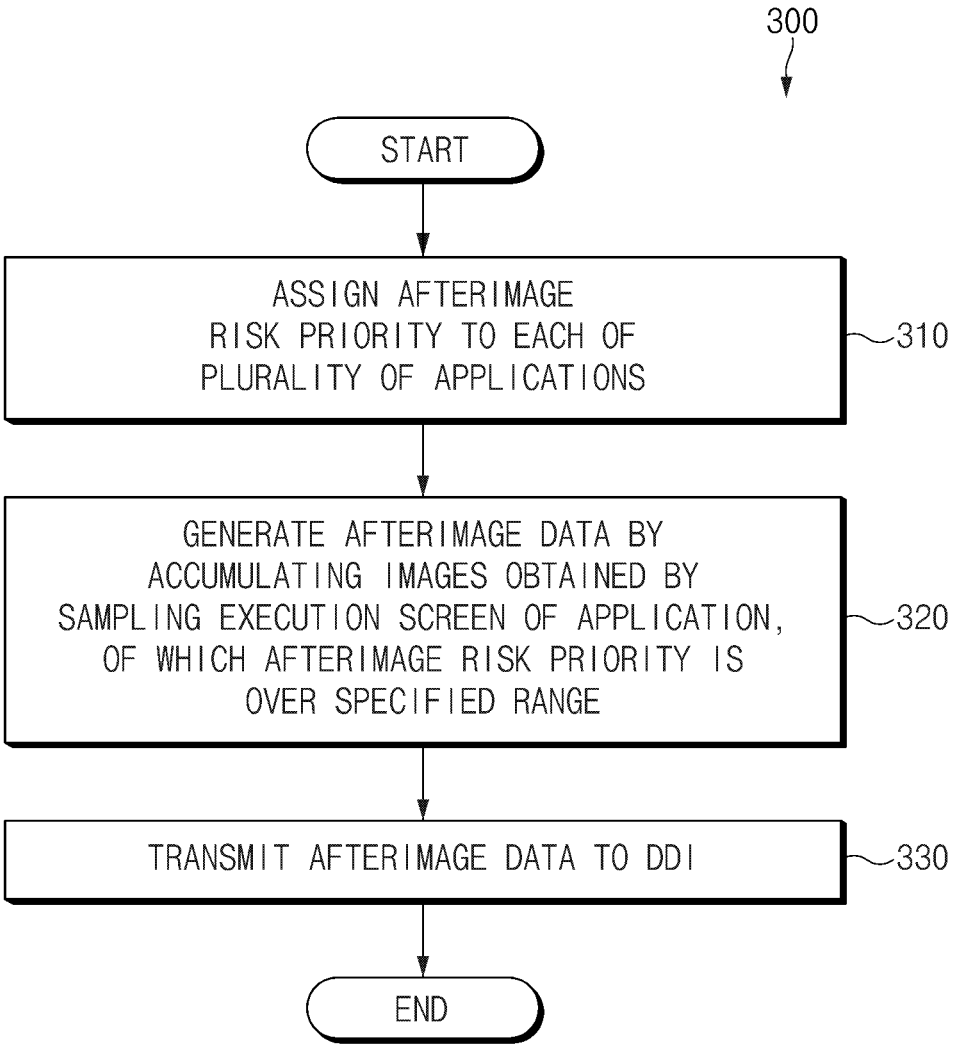
FIG. 3 is a flowchart illustrating a driving method of an electronic device, according to an embodiment.

FIG. 3 is a flowchart 300 illustrating a driving method of an electronic device, according to an embodiment.

According to an embodiment, in operation 310, the electronic device 101 may assign an afterimage risk priority to each of a plurality of applications. The electronic device 101 may assign an afterimage risk priority for each application executed when an application is executed.

In an embodiment, each of the plurality of applications may display an execution screen on the display 210, and thus an afterimage may occur. The degree of risk that an afterimage occurs may be different depending on the type of an application displaying the execution screen. The processor 120 of the electronic device 101 may assign an afterimage risk priority according to the degree of risk that an afterimage occurs to each of the plurality of applications. For example, the electronic device 101 may assign an afterimage risk priority by using a parameter. As another example, the electronic device 101 may assign an afterimage risk priority by using external data.

In an embodiment, the processor 120 of the electronic device 101 may determine the afterimage risk priority by analyzing parameters for each application. The processor 120 may obtain parameters corresponding to each application executed by the electronic device 101.

In an embodiment, the parameters may include a usage time of a specified application, the luminance of an execution screen of the specified application, or data usage of the specified application. As the usage time of the specified application, the luminance of the execution screen of the specified application, or the data usage of the specified application increases, the afterimage generated by the execution screen displayed by the specified application may increase. Accordingly, on the basis of an embodiment, as the usage time of the specified application, the luminance of the execution screen of the specified application, or the data usage of the specified application increases, the processor 120 may determine that an afterimage risk priority of the corresponding application is high.

In an embodiment, the processor 120 of the electronic device 101 may determine the afterimage risk priority by using the external data associated with an application. The processor 120 may assign an afterimage risk priority depending on a frequency at which an afterimage occurs, by analyzing the external data such as big data used for an application or big data received by a service center. The big data used for an application may be information that is data generated by a device using the corresponding application and then is collected by a server (e.g., a cloud or a service providing server). The big data received by a service center may be a set of information indicating that an afterimage occurs while the corresponding application is used, in terms of repairing an afterimage. The processor 120 may assign a high priority to an application in which an afterimage frequently occurs.

According to an embodiment, in operation 320, the electronic device 101 may generate afterimage data by accumulating images obtained by sampling an execution screen of an application, of which the afterimage risk priority is over a specified range. Upon displaying the execution screen of the application, of which the afterimage risk priority is over the specified range, afterimages may occur in most of the display 210. Accordingly, when sampling the execution screen of the application, of which the afterimage risk priority is over the specified range, the processor 120 of the electronic device 101 may prevent or compensate for most of the afterimages. The processor 120 may detect a case where a specified application, of which the afterimage risk priority is over the specified range, from among a plurality of applications is executed. The processor 120 may sample the execution screen of the application at a specified time interval, and may accumulate the sampled image on the previously sampled image.

In an embodiment, when launching an application that generates an afterimage on the display 210, the processor 120 of the electronic device 101 may sample the execution screen at a specified time interval. The processor 120 may accumulate the sampled image on cumulative image data obtained by accumulating previously-sampled images. The processor 120 may generate afterimage data by accumulating sampled images. The afterimage data may be generated by collecting images sampled for each application. The afterimage data may prevent an afterimage from occurring on the display 210 due to the execution screen, or may compensate for the afterimage.

In operation 330, the electronic device 101 according to an embodiment may transmit the afterimage data to the DDI 230. When the execution screen of an application, of which the afterimage risk priority is over the specified range, is displayed, the electronic device 101 may apply the afterimage data corresponding to the application. The processor 120 of the electronic device 101 may determine whether an application, of which the afterimage risk priority is over the specified range, is executed. When the execution screen of the application, of which the afterimage risk priority is over the specified range, is displayed on the display 210, the processor 120 may deliver the afterimage data to the DDI 230 to perform afterimage compensation by applying the afterimage data generated by sampling and accumulating the execution screen of the corresponding application.

Figure 4:
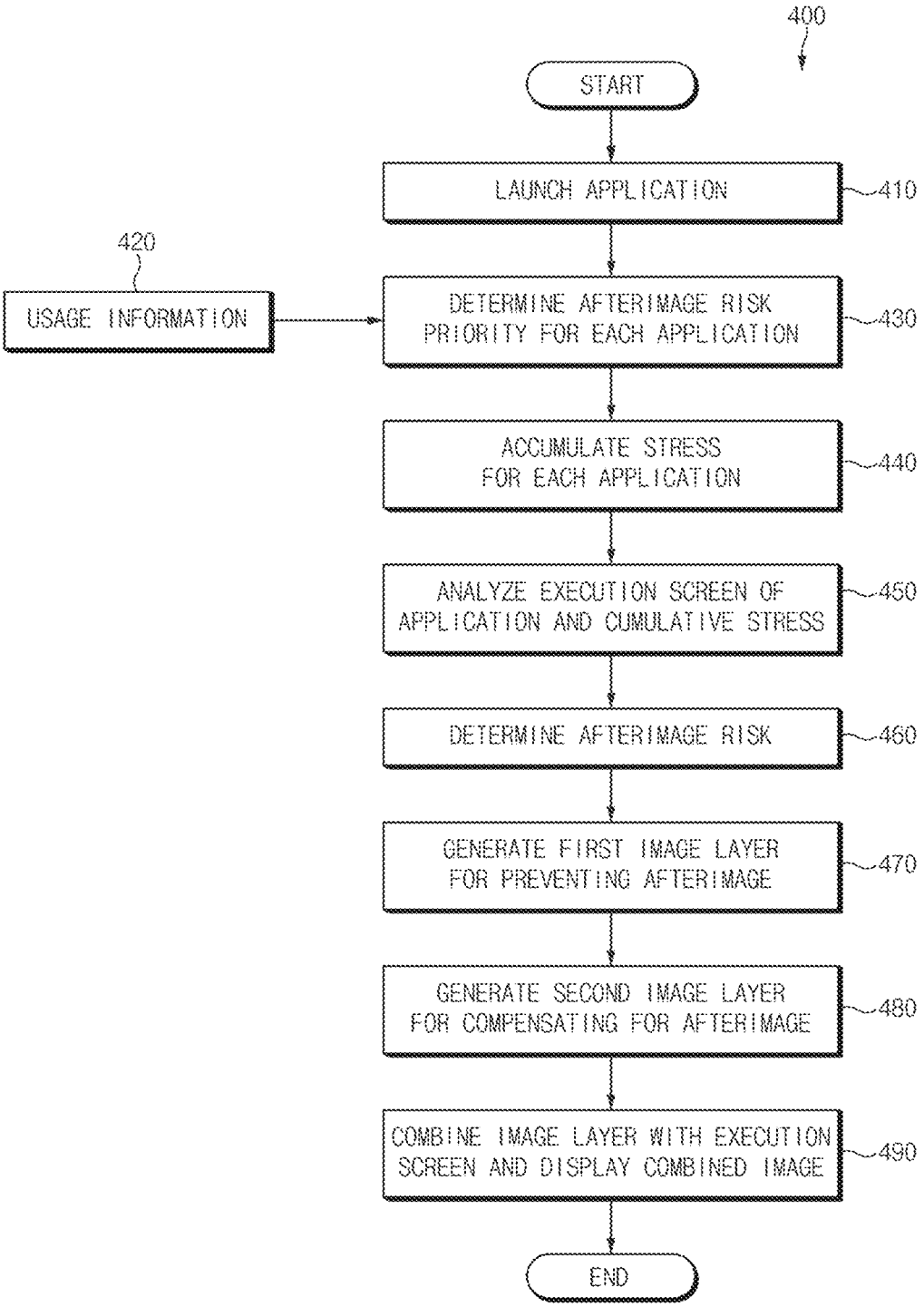
FIG. 4 is a flowchart illustrating an afterimage compensating method of an electronic device, according to an embodiment.

FIG. 4 is a flowchart 400 illustrating an afterimage compensating method of the electronic device 101, according to an embodiment.

In operation 410, the electronic device 101 according to an embodiment may launch an application. The application may display an execution screen on the display 210.

In operation 420, the electronic device 101 according to an embodiment may obtain usage information, which is information internally generated when the electronic device 101 is used. The processor 120 of the electronic device 101 may obtain the usage information of the electronic device 101 by using the sensor module 176. The usage information may include parameters according to an application currently being executed by the electronic device 101. For example, the usage information may be usage time of the application currently being used, power currently consumed by the electronic device 101, currently-used Wi-Fi or data usage, the number of times that a currently-used application is executed, luminance of an execution screen, or temperature of the electronic device 101.

In operation 430, the electronic device 101 according to an embodiment may determine an afterimage risk priority for each application. The processor 120 of the electronic device 101 may calculate an extent, to which an afterimage occurs for each application, using the obtained usage information. For example, the processor 120 may assign a high afterimage risk priority to an application that generates a lot of afterimages by assigning a weight to a parameter, which has an important influence on generating an afterimage, such as the usage time of an application and the luminance of an execution screen.

In operation 440, the electronic device 101 according to an embodiment may accumulate stress according to an image that causes an afterimage to be generated for each application. When an application, of which the afterimage risk priority is over a specified range, is executed, the processor 120 of the electronic device 101 may sample an execution screen of the application at a specified time interval. The processor 120 may accumulate an afterimage stress that occurs on the display 210 due to the corresponding application by accumulating sampled images. Afterimage stress data may be accumulated for each application.

In operation 450, the electronic device 101 according to an embodiment may analyze an execution screen of an application and the accumulated stress. The processor 120 of the electronic device 101 may calculate a portion vulnerable to an afterimage by analyzing images obtained by sampling the execution screen of an application and stress accumulated after the sampling. The execution screen of an application may be used to prevent an afterimage. The accumulated stress may be used to compensate for an afterimage. The accumulated afterimage stress data may be managed for each application. For example, the accumulated afterimage stress data may be stored in the memory 130 of the electronic device 101 so as to be used when the execution screen of the application is displayed.

In operation 460, the electronic device 101 according to an embodiment may determine an afterimage risk. The processor 120 of the electronic device 101 may analyze the degree of risk that an afterimage is capable of occurring due to the execution screen of an application. The processor 120 may determine whether there is a need for afterimage prevention or afterimage compensation for the execution screen.

In operation 470, the electronic device 101 according to an embodiment may generate a first image layer for preventing an afterimage. The processor 120 of the electronic device 101 may generate the first image layer that is an image separate from the execution screen. To prevent an afterimage, the first image layer may be stored in the memory 130 so as to be used when the execution screen of the corresponding application is displayed.

In operation 480, the electronic device 101 according to an embodiment may generate a second image layer for compensating for an afterimage. The processor 120 of the electronic device 101 may generate the second image layer that is an image separate from the execution screen. To compensate for an afterimage, the second image layer may be stored in the memory 130 so as to be used when the execution screen of the application is displayed.

In operation 490, the electronic device 101 according to an embodiment may combine an image layer with an execution screen and then may display the combined image. When the execution screen of the application is displayed on the display 210, the processor 120 of the electronic device 101 may load an image layer corresponding to the corresponding application. The processor 120 may output a final result image using data, which is obtained by combining data corresponding to the generated image layer with image data corresponding to the execution screen, to the display 210.

Figure 5:
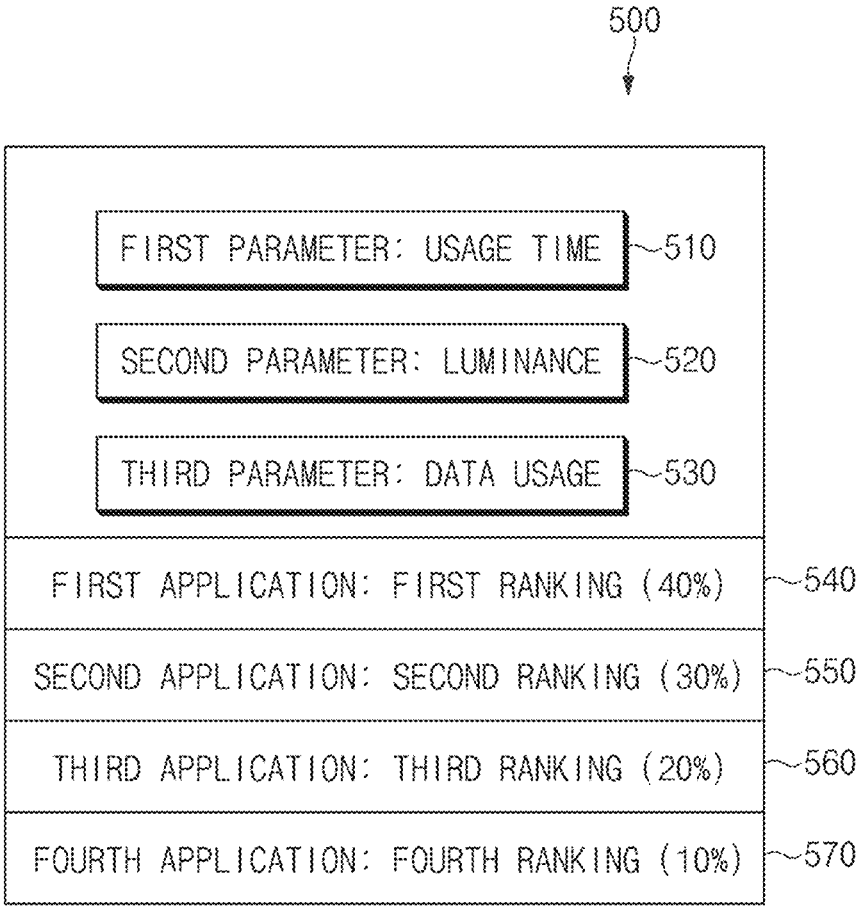
FIG. 5 is a diagram illustrating that an electronic device assigns an afterimage risk priority or a percent ratio to each of a plurality of applications based on parameters, according to an embodiment.

FIG. 5 is a diagram 500 illustrating that an electronic device assigns an afterimage risk priority 540, 550, 560, or 570 or a percent probability (percentage, %) to each of a plurality of applications based on parameters 510, 520, and 530, according to an embodiment.

In an embodiment, when launching an application, the electronic device 101 may display an execution screen on the display 210. The operation state of the electronic device 101 may be expressed using usage information obtained from the sensor module 176. The usage information may include a plurality of parameters associated with the execution screen of an application. When determining the degree of risk that an afterimage occurs upon displaying the execution screen, the processor 120 of the electronic device 101 may extract necessary parameters from the usage information. For example, the processor 120 of the electronic device 101 may extract first to third parameters 510, 520, and 530 from the usage information. The first parameter 510 may be a usage time; the second parameter 520 may be luminance; and, the third parameter 530 may be data usage.

In an embodiment, the processor 120 of the electronic device 101 may calculate an afterimage risk priority by using the plurality of parameters. The processor 120 may assign numerical information such as a score or weight for each of the plurality of parameters according to the display screen of an application to the application and then may calculate the afterimage risk priority of the corresponding application. For example, the processor 120 may assign a triple weight to the first parameter 510 having the greatest influence on the afterimage occurring on the display 210, may assign a double weight to the second parameter 520 having the next greatest influence on the afterimage occurring on the display 210, and may assign a 0.5 times weight to the third parameter 530 having the smallest influence on the afterimage occurring on the display 210.

In an embodiment, the processor 120 of the electronic device 101 may set the priority of the first parameter 510, the priority of the second parameter 520, and the priority of the third parameter 530 for each application. For example, the processor 120 may analyze the plurality of parameters 510, 520, and 530 for each application, and may determine the priority of a risk that an afterimage occurs. The processor 120 may assign the afterimage risk priorities 540, 550, 560, and 570 respectively corresponding to a plurality of applications, based on a priority of each of the plurality of parameters 510, 520, and 530 and a weight of each of the plurality of parameters 510, 520, and 530 as shown in Table 1. Furthermore, as shown in Table 1, the processor 120 may indicate the degree of afterimage generated by each application as a percentage probability, together with the afterimage risk priorities 540, 550, 560, and 570 respectively corresponding to the plurality of applications.

TABLE 1

| Application | First parameter 510 | Second parameter 520 | Third parameter 530 | Final afterimage risk priority |
|---|---|---|---|---|
| First application | First ranking | First ranking | First ranking | First ranking (40%)(540) |
| Second application | Second ranking | Third ranking | Third ranking | Second ranking (30%)(550) |
| Third application | Third ranking | Second ranking | Fourth ranking | Third ranking (20%)(560) |
| Fourth application | Fourth ranking | Fourth ranking | Second ranking | Third ranking (10%)(570) |

In an embodiment, the processor 120 of the electronic device 101 may set a range of an afterimage risk priority. An application, of which the risk of an afterimage generated on the display 210 due to the execution screen of the application is over a specified value, may be identified through the range of the afterimage risk priority. When the execution screen of the application, of which the afterimage risk priority is over the specified range, is displayed, the processor 120 may perform afterimage prevention or afterimage compensation. When the execution screen of an application, of which the afterimage risk priority is below the specified range, is displayed, the processor 120 may display the execution screen without performing afterimage prevention or afterimage compensation. Alternatively, when an application that generates an afterimage having a specified percent probability or higher is executed, the processor 120 may perform afterimage prevention or afterimage compensation. When an application that generates an afterimage having the specified percent probability or lower is executed, the processor 120 may not perform afterimage prevention or afterimage compensation. For example, in the case where the specified range of afterimage risk priority is specified as the second ranking or higher, the processor 120 may perform afterimage prevention or afterimage compensation when the first application or the second application is executed, and the processor 120 may not perform afterimage prevention or afterimage compensation when the third application or the fourth application is executed.

Figure 6:
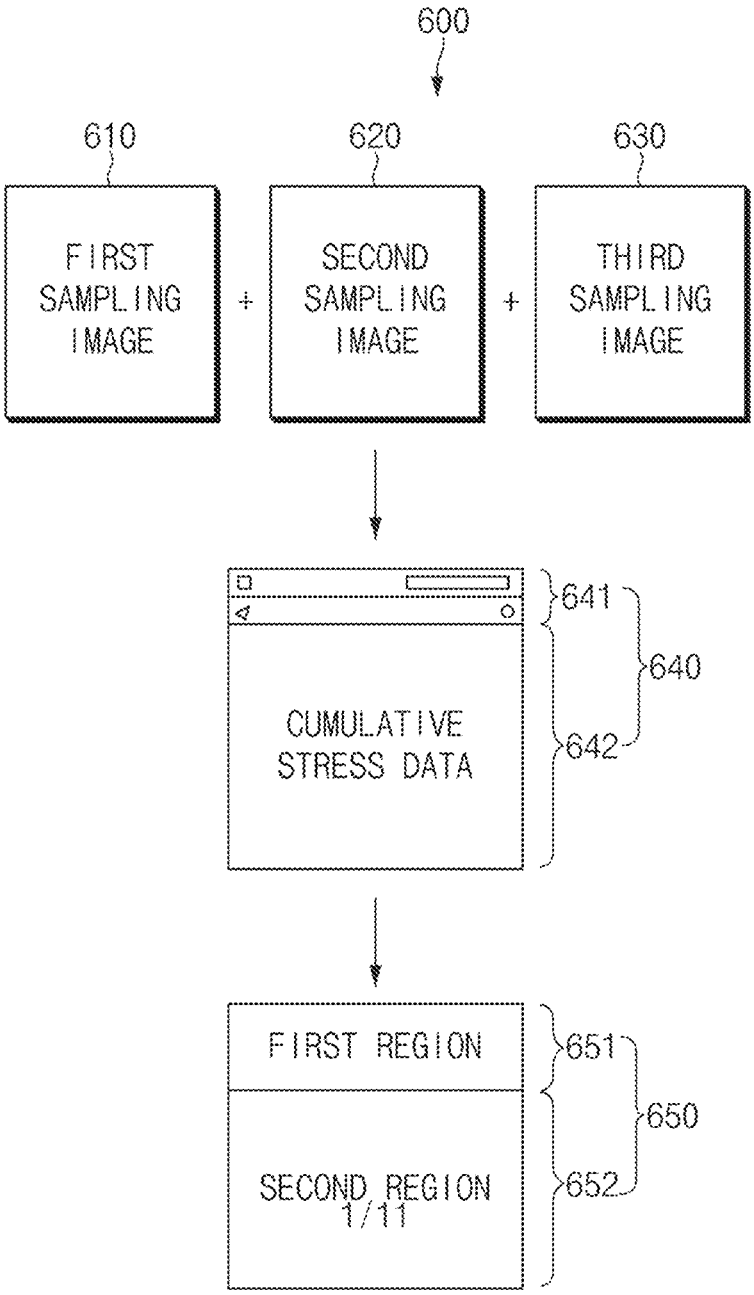
FIG. 6 is a diagram illustrating that an electronic device accumulates an image obtained by sampling an execution screen of a specified application, according to an embodiment.

FIG. 6 is a diagram 600 illustrating that the electronic device 101 accumulates an image obtained by sampling an execution screen of a specified application, according to an embodiment.

In an embodiment, when a specified application, of which an afterimage risk priority is over a specified range, from among a plurality of applications is executed, the processor 120 of the electronic device 101 may sample an execution screen of the corresponding application. For example, when the execution screen of the first application having an afterimage risk priority of the first ranking (540) is displayed on the display 210, the processor 120 may sample the execution screen of the first application at a specified time interval. For example, the processor 120 may generate a first sampling image 610, a second sampling image 620, and a third sampling image 630 by sampling the execution screen of the first application.

In an embodiment, the processor 120 of the electronic device 101 may sequentially accumulate the generated sampling images 610, 620, and 630. The processor 120 may accumulate the currently-sampled image in the previously-sampled image. For example, the processor 120 may sequentially generate the first to third sampling images 610, 620, and 630. When generating the second sampling image 620, the processor 120 may accumulate the second sampling image 620 in the first sampling image 610. Also, when generating the third sampling image 630, the processor 120 may accumulate the third sampling image 630 in an image in which the first and second sampling images 610 and 620 are accumulated.

In an embodiment, the processor 120 of the electronic device 101 may generate cumulative stress data 640 by accumulating the plurality of sampling images 610, 620, and 630. The cumulative stress data 640 may be an image indicating that an afterimage is generated on the display 210 by the plurality of sampling images 610, 620, and 630. The cumulative stress data 640 may reflect all effects of an execution screen on the display 210, using the plurality of sampling images 610, 620, and 630.

In an embodiment, the cumulative stress data 640 may include a fixed portion 641 and a variable portion 642. The fixed portion 641 may be a portion among sampled images, the similarity is not less than a specified value in comparison with the previous sampling image. The variable portion 642 may be a portion, of which the similarity with the previous sampling image among the sampled images is less than the specified value. For example, a uniform portion of the execution screen of an application, such as a platform, an outline, and a frame, may maintain a uniform shape, color, or luminance for a long time. Furthermore, a portion for displaying information, which is entered by a user in the execution screen of the application, or a portion for displaying an operation of an application in the execution screen of the application may have a shape, color, or luminance different from the shape, color, or luminance at a point in time when the sampling has been performed previously.

In an embodiment, the processor 120 of the electronic device 101 may be configured to process data obtained by sampling the fixed portion 641 separately from the variable portion 642 changed over time. The fixed portion 641 may maintain uniform data without changing even when the sampling is continuously performed. Accordingly, a portion determined as the fixed portion 641 may not be continuously sampled unlike the variable portion 642. The processor 120 may determine whether the cumulative stress data 640 converges to a specified value in a portion having the similarity that is not less than the specified value, by analyzing the sampled data.

In an embodiment, the processor 120 of the electronic device 101 may change a period at which the fixed portion 641 is sampled. The processor 120 may set the period, at which the fixed portion 641 is sampled, to be different from a period at which the variable portion 642 is sampled.

For example, the processor 120 may increase a sampling period of the fixed portion 641. Because the fixed portion 641 is a portion where a screen is maintained, a cumulative stress may be calculated even when the sampling period is increased. Accordingly, the processor 120 may set a sampling period of the fixed portion 641 to be longer than the sampling period of the variable portion 642.

As another example, the processor 120 may reduce the sampling period of the fixed portion 641. When a layout of the fixed portion 641 is changed due to an update of an application that has previously accumulated afterimage data, the processor 120 may intensively obtain afterimage data associated with a new layout. To intensively obtain the afterimage data associated with a layout, the processor 120 may compare the afterimage data associated with the new layout with the accumulated afterimage data, may reduce a sampling period during a specific time after the change, and may intensively obtain the afterimage data. As such, when the layout is changed due to the update of an application, the processor 120 may set the sampling period of the fixed portion 641 to be shorter than that of the variable portion 642.

In an embodiment, the processor 120 of the electronic device 101 may generate an image layer 650 in which a region, in which the cumulative stress data 640 converges to the specified value, is specified as a first region 651, and a region changed over time is specified as a second region 652. The processor 120 may determine that the first region 651 continuously displays content corresponding to the specified value to which the cumulative stress data 640 converges. The processor 120 may generate afterimage data corresponding to a specified value to which the cumulative stress data 640 converges in the first region 651. The processor 120 may generate data obtained by averaging images sampled in the second region 652. Because the displayed content is continuously changed in the second region 652, the processor 120 may determine that a risk that an afterimage occurs in the second region 652 is lower than a risk that an afterimage occurs in the first region 651.

In an embodiment, the electronic device 101 may transmit at least part of data constituting the image layer 650 to an external server (e.g., the server 108 in FIG. 1). For example, the communication module 190 of the electronic device 101 may transmit, to the server, data obtained by averaging the first region 651 in which the cumulative stress data 640 is converged to a specified value, and the second region 652, in the image layer 650. The server may generate the image layer 650 by receiving data obtained by averaging the first region 651, in which the cumulative stress data 640 is converged to a specified value, and the second region 652. The server may store the image layer 650 or transmit the image layer 650 to another electronic device. As another example, the communication module 190 of the electronic device 101 may transmit only data corresponding to the first region 651, in which the cumulative stress data 640 is converged to the specified value, in the image layer 650 to the server. In this case, the second region 652 may be configured to store and process data averaged by the processor 120 of the electronic device 101.

Figure 7:
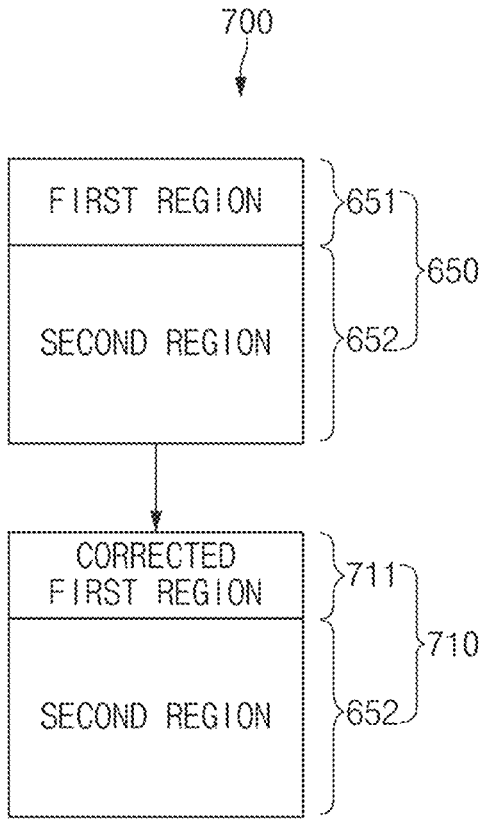
FIG. 7 is a diagram illustrating that an electronic device corrects a specific region to prevent an afterimage, according to an embodiment.

FIG. 7 is a diagram 700 illustrating that the electronic device 101 corrects a specific region to prevent an afterimage, according to an embodiment.

In an embodiment, the processor 120 of the electronic device 101 may analyze an execution screen of an application. The processor 120 may divide the execution screen into a plurality of regions and may analyze the plurality of regions. For example, the processor 120 may divide the execution screen into the first region 651 where uniform content is displayed during a long time and the second region 652 where content is changed over time and may analyze the first region 651 and the second region 652.

In an embodiment, the processor 120 of the electronic device 101 may analyze a cumulative stress or the image layer 650 generated by accumulating a sampled image. The processor 120 may divide the image layer 650 into a plurality of regions and then may analyze the plurality of regions. For example, the processor 120 may divide the image layer 650 into the first region 651 where uniform content is displayed during a long time and the second region 652 where content is changed over time, and may analyze the first region 651 and the second region 652.

In an embodiment, the processor 120 of the electronic device 101 may set a region, in which a luminance that is not less than a specified luminance is maintained to be longer than a specified time, as an afterimage vulnerable part. For example, the processor 120 may set the first region 651, of which the high luminance is maintained due to the displaying of content in a form of a platform made of colors with a high luminance, as an afterimage vulnerable part.

In an embodiment, the processor 120 of the electronic device 101 may correct a region set as the afterimage vulnerable part, and may display a corrected first region 711. For example, the processor 120 may correct the image data so as to reduce the luminance of the first region 651 set as the afterimage vulnerable part, and then may display an execution screen 710 including the corrected first region 711. When the corrected first region 711 is displayed, a possibility or risk that an afterimage is capable of occurring may be reduced as compared to a case where the first region 651 is displayed without correction to prevent an afterimage.

In an embodiment, the processor 120 of the electronic device 101 may control the DDI 230 so as to correct the region set as the afterimage vulnerable part. For example, the processor 120 may control the DDI 230 to reduce the luminance of the first region 651 set as the afterimage vulnerable part. When the DDI 230 displays the execution screen 710 including the corrected first region 711 by reducing the luminance of the first region 651, a possibility or risk that an afterimage is capable of occurring may be reduced as compared to a case where the first region 651 is displayed without correction to prevent an afterimage.

Figure 8:
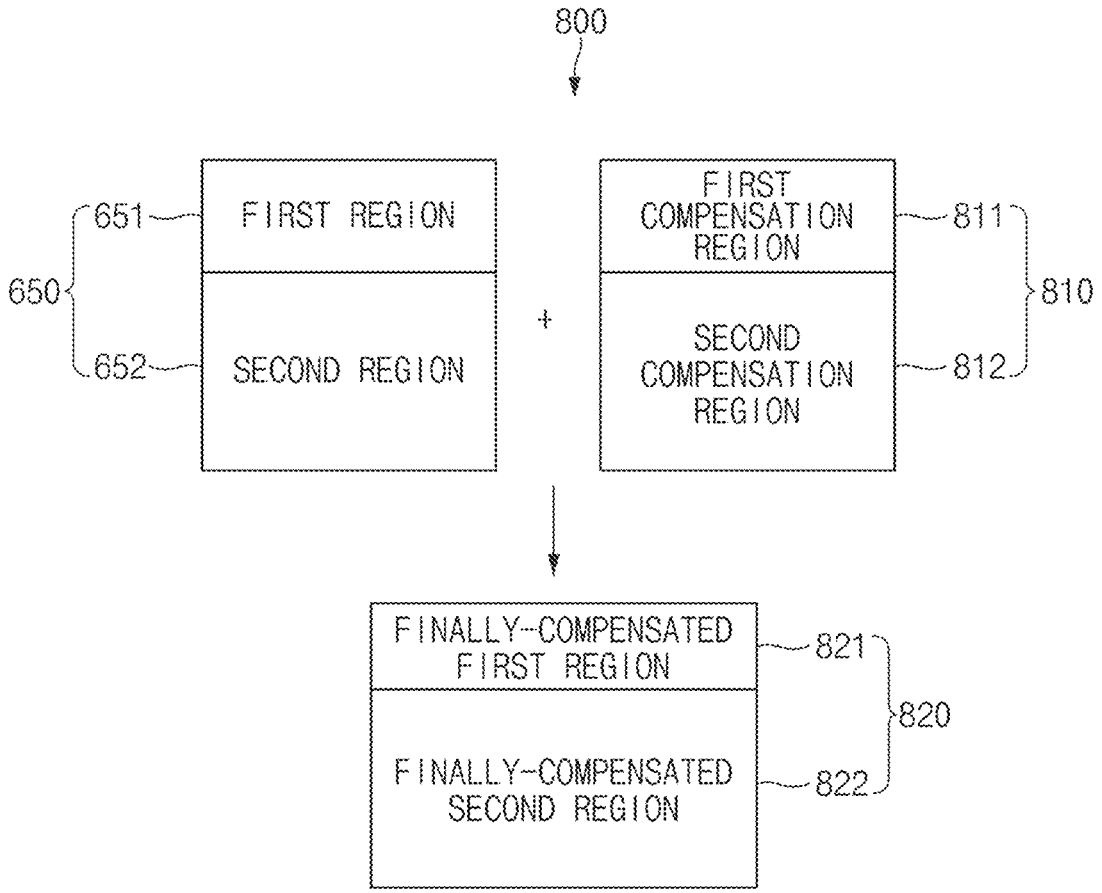
FIG. 8 is a diagram illustrating that an electronic device compensates for an afterimage by using an image layer, according to an embodiment.

FIG. 8 is a diagram 800 illustrating that the electronic device 101 compensates for an afterimage by using the image layer 650, according to an embodiment.

In an embodiment, the processor 120 of the electronic device 101 may combine the image layer 650 with an execution screen 810 to be compensated. The processor 120 may combine an image of the first region 651 set as an afterimage vulnerable part in the image layer 650 to a first compensation region 811 and may combine an image of the second region 652 obtained by averaging changing content to a second compensation region 812.

In an embodiment, the electronic device 101 may receive data associated with the image layer 650 stored in an external server (e.g., the server 108 in FIG. 1) and may combine the data with the execution screen 810. For example, the communication module 190 of the electronic device 101 may receive data of the afterimage vulnerable part stored in the server, may generate the first region 651 of the image layer 650, and may combine the generated first region 651 with the first compensation region 811.

In an embodiment, the electronic device 101 may combine the image layer 650 and the execution screen 810 and may display a finally-compensated execution screen 820 on the display 210. The display 210 of the electronic device 101 may display the execution screen 820, in which the luminance of the afterimage vulnerable part is reduced, by combining the first region 651 of the image layer 650 with the first compensation region 811. The finally-compensated execution screen 820 may reduce a possibility or risk that an afterimage occurs on the display 210 more than the execution screen 810 to be compensated.

In an embodiment, the processor 120 of the electronic device 101 may be configured to display the finally-compensated execution screen 820 to the display 210 by combining afterimage data corresponding to the image layer 650 with image data for displaying the execution screen 810. The processor 120 may be configured to reduce the luminance of the first compensation region 811, in which image data is set as the afterimage vulnerable part, using afterimage data.

In an embodiment, the processor 120 of the electronic device 101 may be configured such that the DDI 230 combines the image layer 650 with the execution screen 810 to be compensated, and then displays the finally-compensated execution screen 820 on the display 210. The DDI 230 may be configured to reduce luminance of the first compensation region 811 set as an afterimage vulnerable part by combining the image layer 650 delivered from the processor 120 with the execution screen 810.

Figure 9:
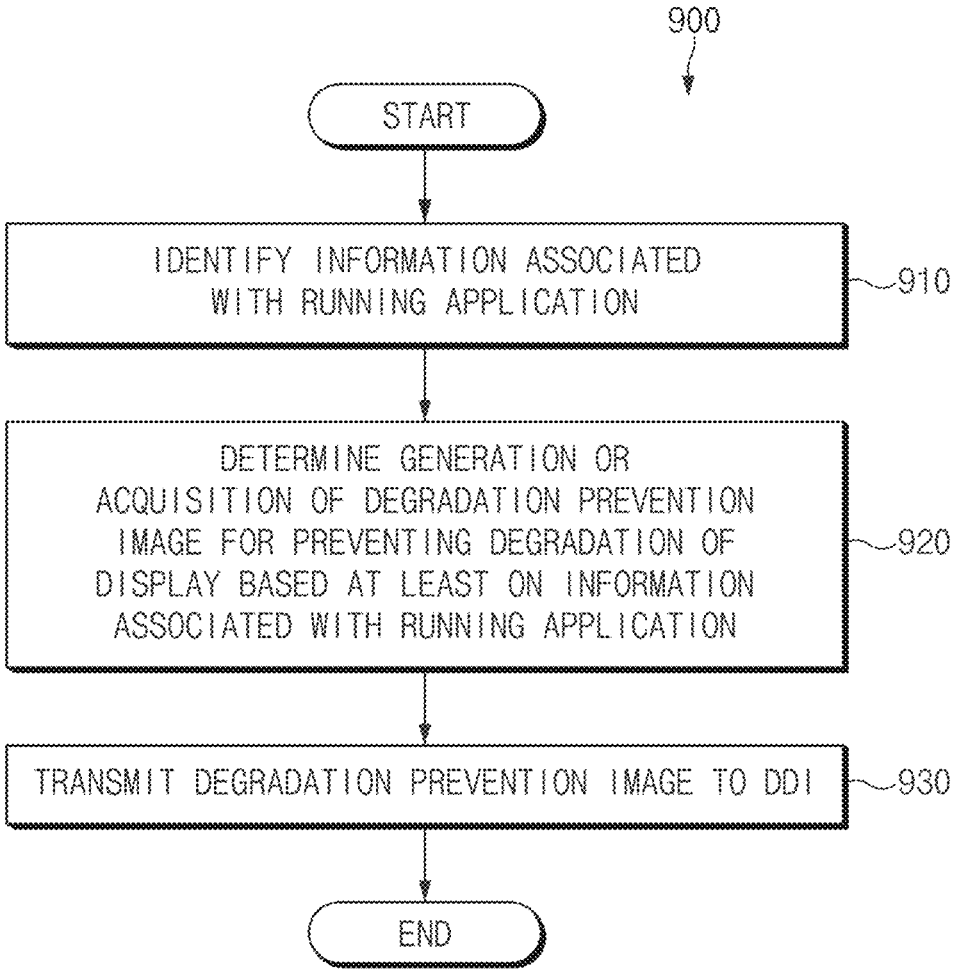
FIG. 9 is a flowchart illustrating a method of generating or obtaining an image for preventing degradation by an electronic device, according to an embodiment.

FIG. 9 is a flowchart 900 illustrating a method of generating or obtaining an image for preventing degradation by an electronic device, according to an embodiment.

In operation 910, the electronic device 101 according to an embodiment may identify information associated with a running application. The electronic device 101 may store information such as a luminance, usage time, or data usage of an execution screen of the running application in the memory 130. The electronic device 101 may store information such as the luminance, usage time, or data usage of the execution screen of the running application to the server 108 through the communication module 190.

In operation 920, the electronic device 101 according to an embodiment may determine the generation or acquisition of a degradation prevention image for preventing degradation of the display 210, based at least on information associated with the running application. The degradation prevention image may be a first image layer for preventing an afterimage due to degradation of the display 210 or a second image layer for compensating for an afterimage due to degradation of the display 210. To generate the degradation prevention image, the electronic device 101 may identify the degree of occurrence of an afterimage by using parameters associated with occurrence of the degradation from information associated with the running application, through the processor 120 or the memory 130. To obtain the degradation prevention image, the electronic device 101 may receive the degradation prevention image generated based on information delivered by the server 108 by using the communication module 190.

In operation 930, the electronic device 101 according to an embodiment may transmit the degradation prevention image to the DDI 230. When the degradation prevention image includes an image layer associated with afterimage prevention, the DDI 230 may prevent an afterimage by combining the degradation prevention image with original image data. Alternatively, when the degradation prevention image includes an image layer associated with afterimage compensation, the DDI 230 may compensate for an afterimage by combining the degradation prevention image with original image data.

Figure 10:
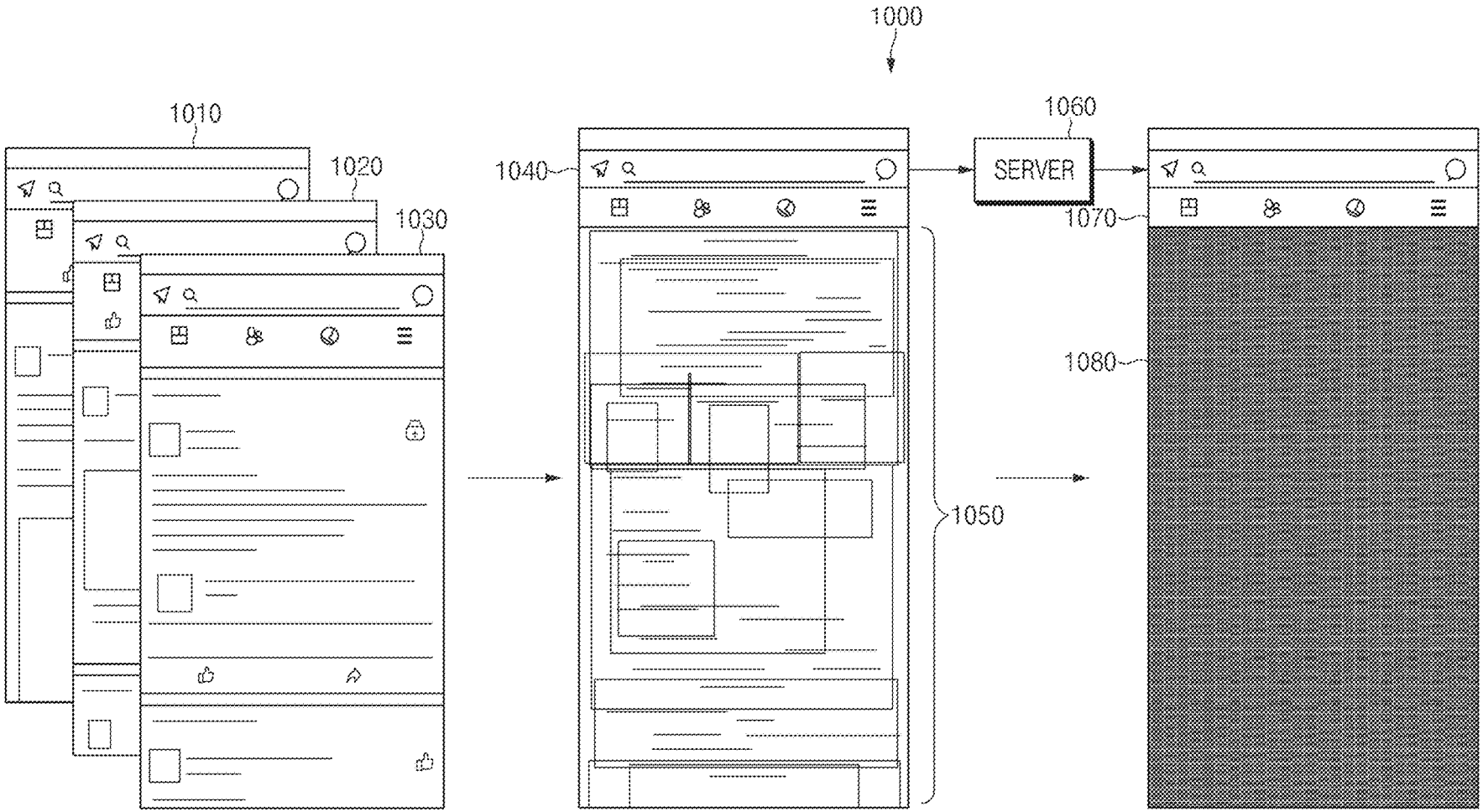
FIG. 10 is a diagram illustrating a procedure in which an electronic device generates cumulative stress data by sampling a plurality of images and generates image layers by determining cumulative stress data converges, according to an embodiment.

FIG. 10 is a diagram 1000 illustrating a procedure in which the electronic device 101 generates cumulative stress data 1040 and 1050 by sampling a plurality of images 1010, 1020, and 1030 and generates image layers 1070 and 1080 by determining the cumulative stress data 1040 and 1050 converges, according to an embodiment.

In an embodiment, the processor 120 of the electronic device 101 may sample the plurality of images 1010, 1020, and 1030 at a specified time interval. For example, when the electronic device 101 launches an application (e.g. Facebook™) and then the display 210 displays an execution screen of an application, the electronic device 101 may generate the plurality of images 1010, 1020, and 1030 by sampling an execution screen at a specified time interval while displaying the execution screen.

In an embodiment, the processor 120 of the electronic device 101 may generate the cumulative stress data 1040 and 1050 by accumulating the plurality of images 1010, 1020, and 1030. The processor 120 may accumulate the currently-sampled image 1030 in an image in which the previous sampling images 1010 and 1020 are accumulated, and then may generate the cumulative stress data 1040 and 1050. The processor 120 may divide the cumulative stress data 1040 and 1050 into the fixed portion 1040 and the variable portion 1050. The fixed portion 1040 may have a similarity with a previous sampling image, which is not less than a specified value. The variable portion 1050 may have a similarity with a sampling image less than the specified value. The processor 120 may store at least part of the cumulative stress data 1040 and 1050 in the memory 130, may deliver at least part of the cumulative stress data 1040 and 1050 to the DDI 230, or may convert at least part of the cumulative stress data 1040 and 1050 into an image to process the converted image.

In an embodiment, the electronic device 101 may be configured to transmit, to a server 1060 outside the electronic device 101, data obtained by sampling the fixed portion 1040 of the cumulative stress data 1040 and 1050 that is based on the images 1010, 1020, and 1030 obtained by sampling the execution screen. The communication module 190 of the electronic device 101 may transmit data corresponding to the fixed portion 1040 to the server 1060. The server 1060 may store the data corresponding to the fixed portion 1040. The server 1060 may generate an image capable of preventing or compensating for an afterimage of the fixed portion 1040 based on the data corresponding to the fixed portion 1040. The server 1060 may generate an image corresponding to the fixed portion 1040 based on data received from the electronic device 101 and other electronic devices.

In an embodiment, the electronic device 101 may receive an image 1070 capable of preventing or compensating for an afterimage of the fixed portion 1040 from the server 1060. The processor 120 of the electronic device 101 may combine the image 1070 capable of preventing or compensating for the afterimage of the fixed portion 1040 with an image 1080, in which data obtained by averaging the variable portion 1050 of the cumulative stress data 1040 and 1050 is displayed, and then may generate the image layers 1070 and 1080 corresponding to the execution screen. The processor 120 of the electronic device 101 may store the image layers 1070 and 1080 in the memory 130.

Figure 11:
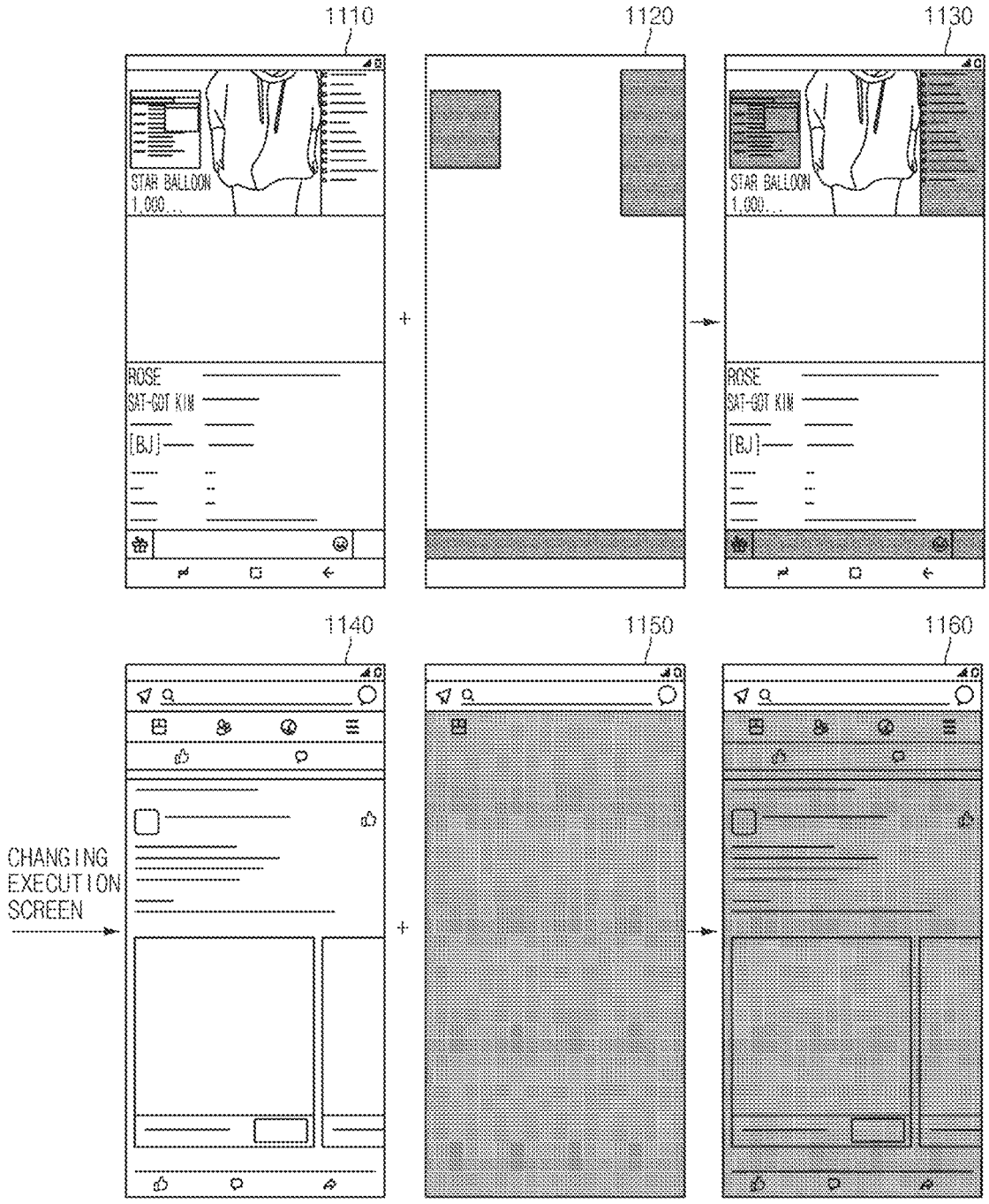
FIG. 11 is a view illustrating a method in which an electronic device prevents an afterimage by applying an image layer corresponding to an execution screen, according to an embodiment.

FIG. 11 is a view illustrating a method in which the electronic device 101 prevents an afterimage by applying an image layer corresponding to an execution screen, according to an embodiment.

In an embodiment, the electronic device 101 may display, on the display 210, a first execution screen 1110, which is an execution screen of a first application (e.g., Africa TV'), of which an afterimage risk priority is assigned to be over a specified range. When the display 210 displays the first execution screen 1110, the processor 120 of the electronic device 101 may load a first image layer 1120, which is generated based on the execution screen of the first application to compensate for the first execution screen 1110 and then is stored in the memory 130.

In an embodiment, the first image layer 1120 may be generated by sampling and accumulating an execution screen displayed when the first application is executed. The first image layer 1120 may be set to reduce a possibility or risk that an afterimage occurs due to the execution screen of the first application. For example, the first image layer 1120 may set a region, in which a luminance that is not less than a specified luminance is maintained on the first execution screen 1110 during a specified time or more, as an afterimage risk part and then may generate a luminance reduction region in a region corresponding to an afterimage risk part so as to reduce the luminance of the afterimage risk part.

In an embodiment, the electronic device 101 may display a first execution screen 1130 corrected by combining the first image layer 1120 with the first execution screen 1110. For example, the processor 120 of the electronic device 101 may be configured to display the corrected first execution screen 1130 by combining image data for displaying the first execution screen 1110 with data corresponding to the first image layer 1120. As another example, the processor 120 of the electronic device 101 may control the DDI 230 to display the first execution screen 1130 corrected to reduce a luminance of the afterimage risk part by combining the first execution screen 1110 with the first image layer 1120. When the display 210 displays the corrected first execution screen 1130, it is possible to reduce a possibility that an afterimage occurs in an afterimage risk area more than a possibility in a case where the display 210 displays the first execution screen 1110.

In an embodiment, the electronic device 101 may display, on the display 210, a second execution screen 1140, which is an execution screen of a second application (e.g. Facebook™) of which an afterimage risk priority is assigned to be over a specified range and which displays content different from that of the first application. When the display 210 displays the second execution screen 1140, the processor 120 of the electronic device 101 may load a second image layer 1150, which is generated based on the execution screen of the second application to compensate for the second execution screen 1140 and then is stored in the memory 130. When the display 210 displays the first execution screen 1110 and then changes the first execution screen 1110 to the second execution screen 1140, the processor 120 may be configured to stop an operation of applying the first image layer 1120 to the execution screen and to apply the second image layer 1150 to the execution screen.

In an embodiment, the second image layer 1150 may be generated by sampling and accumulating an execution screen displayed when the second application is executed. The second image layer 1150 may be set to reduce a possibility or risk that an afterimage occurs due to the execution screen of the second application. For example, the second image layer 1150 may be displayed to set a region, in which the same content (e.g., an upper platform) is maintained on the second execution screen 1140 during a specified time or more, as an afterimage risk part and to include an image obtained by inverting the afterimage risk part. As another example, the second image layer 1150 may generate data obtained by averaging regions, in each of which content (e.g., an information display region in a center part) changed on the second execution screen 1140 is displayed, and then may display the data on the second image layer 1150.

In an embodiment, the electronic device 101 may display a second execution screen 1160 corrected by combining the second execution screen 1140 with the second image layer 1150. For example, the processor 120 of the electronic device 101 may be configured to display the corrected second execution screen 1160 by combining image data for displaying the second execution screen 1140 with data corresponding to the second image layer 1150. As another example, the processor 120 of the electronic device 101 may control the DDI 230 to display the second execution screen 1160 corrected by combining the second execution screen 1140 with the second image layer 1150. When the display 210 displays the corrected second execution screen 1160, it is possible to reduce a possibility that an afterimage occurs in the display 210 more than a possibility in a case where the display 210 displays the second execution screen 1140.

According to various embodiments, an electronic device may include a display, a display driver integrated circuit (DDI) driving the display, and at least one processor operationally connected to the display or the DDI. The at least one processor may assign an afterimage risk priority to each of the plurality of applications, may accumulate an image obtained by sampling an execution screen of the application, of which the afterimage risk priority is assigned to be over the specified range, to generate afterimage data when an application, of which the afterimage risk priority is assigned to be over a specified range, from among the plurality of applications is executed, and may deliver the afterimage data to the DDI.

In an embodiment, the at least one processor may be configured to assign the afterimage risk priority based on at least one parameter of a usage time of the specified application, a luminance of the execution screen of the specified application, or data usage of the specified application.

In an embodiment, the at least one processor may be configured to assign the afterimage risk priority by using external data associated with the specified application.

In an embodiment, the at least one processor may be configured to determine a similarity between a sampling image obtained by sampling the execution screen and a previous sampling image to set a portion having a specified range or more as a fixed portion, to calculate a convergence of an image accumulated through the similarity between the previous sampling image and the sampling image, and to change a sampling period when the convergence of the image is not less than a specified range.

In an embodiment, the at least one processor may be configured to determine a region, in which a luminance of a specified range or more is maintained to be longer than a specified time on the execution screen, as an afterimage vulnerable part based (at least) on the afterimage data.

In an embodiment, the at least one processor may be configured to generate a first image layer for preventing an afterimage for the execution screen of the specified application, of which the afterimage risk priority is assigned to be higher than a specified priority, from among the plurality of applications or a second image layer for compensating for the afterimage.

In an embodiment, the at least one processor may be configured to apply afterimage prevention data for generating a first image layer for preventing an afterimage corresponding to the specified application, or afterimage compensation data for generating a second image layer for compensating for the afterimage when the execution screen of the specified application, of which the afterimage risk priority is specified to be higher than a specified priority, from among the plurality of applications is displayed on the display.

In an embodiment, the at least one processor may be configured to combine a first image layer for preventing an afterimage for the execution screen of the specified application with the execution screen to output the combined image when the execution screen of the specified application, of which the afterimage risk priority is specified to be higher than a specified priority, from among the plurality of applications is displayed on the display.

In an embodiment, the at least one processor may be configured to combine a second image layer for compensating for an afterimage for the execution screen of the specified application with the execution screen to output the combined image when the execution screen of the specified application, of which the afterimage risk priority is specified to be higher than a specified priority, from among the plurality of applications is displayed on the display.

In an embodiment, the at least one processor may be configured to reduce a luminance of a region in which the luminance that is over a specified luminance range is maintained in the afterimage data to be longer than a specified time.

In an embodiment, the at least one processor may be configured to transmit data obtained by sampling a fixed portion having a similarity with a previous sampling image, which is not less than a specified value, in cumulative stress data based on the image obtained by sampling the execution screen to a server outside the electronic device and to obtain the afterimage data generated by using the data in the server.

According to various embodiments, a degradation compensating method of an electronic device may include assigning an afterimage risk priority to each of the plurality of applications, accumulating an image obtained by sampling an execution screen of the application, of which the afterimage risk priority is assigned to be over the specified range, to generate afterimage data when an application, of which the afterimage risk priority is assigned to be over a specified range, from among the plurality of applications is executed, and delivering the afterimage data to a DDI.

In an embodiment, the afterimage risk priority may be assigned by using a parameter of each of the plurality of applications or by using external data associated with the plurality of applications.

In an embodiment, the method may further include calculating a stress convergence of a first portion, of which a similarity with a previous sampling image among images obtained by sampling the execution screen is not less than a specified value and changing a sampling period of the first portion.

In an embodiment, the method may further include determining a region, in which a luminance that is not less than a specified luminance is maintained to be longer than a specified time on the execution screen, as an afterimage vulnerable part by using the afterimage data.

According to various embodiments, an electronic device may include a display, a DDI driving the display, and at least one processor operationally connected to the display or the DDI. The at least one processor may be configured to identify information associated with a running application, to determine generation or acquisition of a degradation prevention image for preventing degradation of the display based at least on information associated with the running application, and to deliver the degradation prevention image to the DDI.

In an embodiment, when the display displays the execution screen, the at least one processor may be configured to combine the degradation prevention image with the execution screen and to perform afterimage compensation.

In an embodiment, the degradation prevention image may be a first image layer for preventing an afterimage due to degradation of the display or a second image layer for compensating for an afterimage due to degradation of the display.

In an embodiment, the at least one processor may be configured to reduce a luminance of a region in which the luminance that is over a specified luminance range is maintained in the afterimage data to be longer than a specified time.

In an embodiment, the generation of the degradation prevention image may be performed in the at least one processor or in a memory inside the electronic device. The acquisition of the degradation prevention image may be performed by transmitting information associated with the running application to a server connected to the electronic device and receiving the degradation prevention image generated by using the information in the server.

The electronic device according to various embodiments may be one of various types of electronic devices. The electronic devices may include, for example, a portable communication device (e.g., a smartphone), a computer device, a portable multimedia device, a portable medical device, a camera, a wearable device, or a home appliance. According to an embodiment of the disclosure, the electronic devices are not limited to those described above.

It should be appreciated that various embodiments of the disclosure and the terms used therein are not intended to limit the technological features set forth herein to particular embodiments and include various changes, equivalents, or replacements for a corresponding embodiment. With regard to the description of the drawings, similar reference numerals may be used to refer to similar or related elements. It is to be understood that a singular form of a noun corresponding to an item may include one or more of the things, unless the relevant context clearly indicates otherwise. As used herein, each of such phrases as "A or B", "at least one of A and B", "at least one of A or B", "A, B, or C", "at least one of A, B, and C", and "at least one of A, B, or C" may include any one of, or all possible combinations of the items enumerated together in a corresponding one of the phrases. As used herein, such terms as "1st" and "2nd", or "first" and "second" may be used to simply distinguish a corresponding component from another, and does not limit the components in other aspect (e.g., importance or order). It is to be understood that if an element (e.g., a first element) is referred to, with or without the term "operatively" or "communicatively", as "coupled with", "coupled to", "connected with", or "connected to" another element (e.g., a second element), it means that the element may be coupled with the other element directly (e.g., wiredly), wirelessly, or via a third element.

As used herein, the term "module" may include a unit implemented in hardware, software, or firmware, and may interchangeably be used with other terms, for example, "logic", "logic block", "part", or "circuitry". A module may be a single integral component, or a minimum unit or part thereof, adapted to perform one or more functions. For example, according to an embodiment, the module may be implemented in a form of an application-specific integrated circuit (ASIC).

Various embodiments as set forth herein may be implemented as software (e.g., the program 140) including one or more instructions that are stored in a storage medium (e.g., internal memory 136 or external memory 138) that is readable by a machine (e.g., the electronic device 101). For example, a processor (e.g., the processor 120) of the machine (e.g., the electronic device 101) may invoke at least one of the one or more instructions stored in the storage medium, and execute it, with or without using one or more other components under the control of the processor. This allows the machine to be operated to perform at least one function according to the at least one instruction invoked. The one or more instructions may include a code generated by a compiler or a code executable by an interpreter. The machine-readable storage medium may be provided in the form of a non-transitory storage medium. Wherein, the term "non-transitory" simply means that the storage medium is a tangible device, and does not include a signal (e.g., an electromagnetic wave), but this term does not differentiate between where data is semi-permanently stored in the storage medium and where the data is temporarily stored in the storage medium.

According to an embodiment, a method according to various embodiments of the disclosure may be included and provided in a computer program product. The computer program product may be traded as a product between a seller and a buyer. The computer program product may be distributed in the form of a machine-readable storage medium (e.g., compact disc read only memory (CD-ROM)), or be distributed (e.g., downloaded or uploaded) online via an application store (e.g., PlayStore™), or between two user devices (e.g., smart phones) directly. If distributed online, at least part of the computer program product may be temporarily generated or at least temporarily stored in the machine-readable storage medium, such as memory of the manufacturer's server, a server of the application store, or a relay server.

According to various embodiments, each component (e.g., a module or a program) of the above-described components may include a single entity or multiple entities. According to various embodiments, one or more of the above-described components may be omitted, or one or more other components may be added. Alternatively or additionally, a plurality of components (e.g., modules or programs) may be integrated into a single component. In such a case, according to various embodiments, the integrated component may still perform one or more functions of each of the plurality of components in the same or similar manner as they are performed by a corresponding one of the plurality of components before the integration. According to various embodiments, operations performed by the module, the program, or another component may be carried out sequentially, in parallel, repeatedly, or heuristically, or one or more of the operations may be executed in a different order or omitted, or one or more other operations may be added.

The invention claimed is:

1. An electronic device comprising:

a display;

a display driver integrated circuit (DDI) configured to drive the display; and at least one processor operationally connected to the display or the DDI, wherein the at least one processor is configured to:

assign an afterimage risk priority to each of a plurality of applications, when an application, of which the afterimage risk priority is assigned to be over a specified range, from among the plurality of applications is executed, generate afterimage data by accumulating an image obtained by sampling an execution screen of the application, of which the afterimage risk priority is assigned to be over the specified range, and deliver the afterimage data to the DDI.

2. The electronic device of claim 1, wherein the at least one processor is configured to:

assign the afterimage risk priority based on at least one parameter of a usage time of the specified application, a luminance of the execution screen of the specified application, or data usage of the specified application.

3. The electronic device of claim 1, the at least one processor is configured to:

assign the afterimage risk priority by using external data associated with the specified application.

4. The electronic device of claim 1, wherein the at least one processor is configured to:

determine a similarity between a sampling image obtained by sampling the execution screen and a previous sampling image to set a portion having a specified range or more as a fixed portion;

calculate a convergence of an image accumulated through the similarity between the previous sampling image and the sampling image; and when the convergence of the image is not less than a specified range, change a sampling period.

5. The electronic device of claim 1, wherein the at least one processor is configured to:

determine a region, in which a luminance of a specified range or more is maintained to be longer than a specified time on the execution screen, as an afterimage vulnerable part based at least on the afterimage data.

6. The electronic device of claim 1, wherein the at least one processor is configured to:

generate a first image layer for preventing an afterimage for the execution screen of the specified application, of which the afterimage risk priority is assigned to be higher than a specified priority, from among the plurality of applications or a second image layer for compensating for the afterimage.

7. The electronic device of claim 1, wherein the at least one processor is configured to:

when the execution screen of the specified application, of which the afterimage risk priority is specified to be higher than a specified priority, from among the plurality of applications is displayed on the display, apply afterimage prevention data for generating a first image layer for preventing an afterimage corresponding to the specified application, or afterimage compensation data for generating a second image layer for compensating for the afterimage.

8. The electronic device of claim 1, wherein the at least one processor is configured to:

when the execution screen of the specified application, of which the afterimage risk priority is specified to be higher than a specified priority, from among the plurality of applications is displayed on the display, combine a first image layer for preventing an afterimage for the execution screen of the specified application with the execution screen to output the combined image.

9. The electronic device of claim 1, wherein the at least one processor is configured to:

when the execution screen of the specified application, of which the afterimage risk priority is specified to be higher than a specified priority, from among the plurality of applications is displayed on the display, combine a second image layer for compensating for an afterimage for the execution screen of the specified application with the execution screen to output the combined image.

10. The electronic device of claim 1, wherein the at least one processor is configured to:

reduce a luminance of a region in which the luminance that is over a specified luminance range is maintained in the afterimage data to be longer than a specified time.

11. The electronic device of claim 1, wherein the at least one processor is configured to:

transmit data obtained by sampling a fixed portion having a similarity with a previous sampling image, which is not less than a specified value, in cumulative stress data based on the image obtained by sampling the execution screen to a server outside the electronic device; and obtain the afterimage data generated by using the data in the server.

12. A degradation compensating method of an electronic device, the method comprising:

assigning an afterimage risk priority to each of a plurality of applications;

when an application, of which the afterimage risk priority is assigned to be over a specified range, from among the plurality of applications is executed, generating afterimage data by accumulating an image obtained by sampling an execution screen of the application, of which the afterimage risk priority is assigned to be over the specified range; and delivering the afterimage data to a display driver integrated circuit (DDI).

13. The method of claim 12, wherein the afterimage risk priority is assigned by using a parameter of each of the plurality of applications or by using external data associated with the plurality of applications.

14. The method of claim 12, further comprising:

calculating a stress convergence of a first portion, of which a similarity with a previous sampling image among images obtained by sampling the execution screen is not less than a specified value; and changing a sampling period of the first portion.

15. The method of claim 12, further comprising:

determining a region, in which a luminance of a specified range or more is maintained to be longer than a specified time on the execution screen, as an afterimage vulnerable part by using the afterimage data.

* * * * *